US006666215B1

(12) United States Patent
Bulriss

(10) Patent No.: US 6,666,215 B1
(45) Date of Patent: Dec. 23, 2003

(54) DEVICE AND METHOD FOR SELECTIVELY APPLYING HAIR TREATMENT

(76) Inventor: Robin L. Bulriss, 14259 E. Ravine Run, Willis, TX (US) 77318

( * ) Notice: Subject to any disclaimer, the term of this patent is extended or adjusted under 35 U.S.C. 154(b) by 0 days.

(21) Appl. No.: 09/678,770

(22) Filed: Oct. 4, 2000

(51) Int. Cl.[7] ..... A45D 2/00
(52) U.S. Cl. ..... 132/222; 132/212; 132/223
(58) Field of Search ..... 132/222, 207, 132/208, 210, 223, 245, 226, 262, 206, 221

(56) References Cited

U.S. PATENT DOCUMENTS 2,377,877 A * 6/1945 Graham ..... 132/207
2,631,593 A * 3/1953 Madore ..... 132/222
4,186,159 A * 1/1980 Huber ..... 261/112.2
4,660,581 A * 4/1987 Yamamoto ..... 132/222
4,810,588 A * 3/1989 Bullock et al. ..... 428/603
4,898,762 A * 2/1990 Brown et al. ..... 428/152
4,969,449 A * 11/1990 Levin ..... 126/332
5,025,850 A * 6/1991 Simpson ..... 132/223
5,538,021 A * 7/1996 Kim ..... 132/222
5,813,419 A * 9/1998 Brams ..... 132/212
6,053,178 A * 4/2000 Todd ..... 132/208
6,237,608 B1 * 5/2001 Kari ..... 132/200
6,497,130 B2 * 12/2002 Nilsson ..... 72/252.5

* cited by examiner

*Primary Examiner*—Pedro Philogene
(74) *Attorney, Agent, or Firm*—O'Neil & McConnell, PLLC; R. Perry McConnell

(57) ABSTRACT

The invention comprises a foil piece for use in treating hair, comprising a ridge pattern which enhances application of the treating agent to the hair. In the preferred embodiment, the ridge pattern will be essentially horizontal when in use. The ridge pattern allows the treating agent to be retained by the foil piece on close proximity to the treated hair.

3 Claims, 1 Drawing Sheet

Sheet 1 of 1

DEVICE AND METHOD FOR SELECTIVELY APPLYING HAIR TREATMENT

FIELD OF THE INVENTION

The invention involves products for use in the hair care industry, specifically products used in coloring hair.

BACKGROUND OF THE INVENTION

Hair stylists often need to selectively apply hair color or other treatments to hair, for example, they may need to color one portion or area of a person's hair. This process is made easier by isolating the area to be treated from the remainder of the hair so that the treating agent will be concentrated on the desired area and will not accidentally affect other areas.

Such isolation can be accomplished by using disposable metal foil pieces, such as a rectangular piece of aluminum foil, placed so that the upper edge of such a piece is adjacent to, and under, the area of hair which is desired to be treated. The hair to be treated can then be overlaid on the foil piece and the treatment applied directly only to the desired area of hair. The foil may then be folded or rolled around the treated hair and held in place with a pin or clip to insure that the treatment fully penetrates the treated area.

Use of such foil pieces is sufficiently widespread that they are sold to hair stylists in boxes of pre-cut rectangular foil pieces. These current products are simple foil sheets, and sometimes bear a stippling pattern which is an artifact of the type of roller used to produce the foil. The current products do not provide any features to enhance the application of the treatment to the hair.

Further, the currently available foil sheets must often be modified by the stylists before use. One example of such needed modification is that stylists may find it convenient to have a fold at the top of each sheet, so that the sheet may be lifted by a comb handle or a similar tool. Such a fold makes it easier for the stylist to select and grip each new foil piece. Further, if the foil is folded over a more rigid tool, such as a comb handle, the foil may be more precisely placed against the base of the hair to be treated. Because such folds are useful but are not provided by the currently available products, stylists must manually fold the foil pieces they wish to use.

It is an object of the invention to provide foil pieces for use in treating hair with features to enhance the process of applying treatments to hair.

It is a further object of the invention to provide foil pieces for use in treating hair with features which provide for greater ease of use than currently available products.

SUMMARY OF THE INVENTION

The present invention is a foil piece for use in treating hair comprising an imprinted ridge pattern which enhances the application of a treating agent to hair. The foil piece is essentially rectangular as a matter of convenience for mass production, storage, shipping, and use. However, any non-rectangular shape may be used so long as it bears the imprinted ridge pattern of the invention.

The invention comprises a foil piece of a size convenient for use in treating hair. In the preferred embodiment, the foil piece will be a rectangle approximately nine inches by five inches. Because these foil pieces are intended to be folded or rolled around the treated hair, the longer axis will be treated as the vertical axis, and the shorter axis as the horizontal axis. The foil piece is preferably made from aluminum foil of approximately 0.65 mil. Those of skill in the art will recognize that thicker or thinner foil may be used, subject only to the operational limits that the foil be sufficiently flexible for the task, and sufficiently strong to resist tearing during normal usage.

The foil piece of this invention is also imprinted with a ridge pattern, which is preferably comprised of horizontal, parallel ridges pressed into the foil piece. The ridges of the ridge pattern are preferably straight. However, variations in the ridge pattern, or a combination of two or more ridge patterns, are within the scope of this invention.

Ridge height, ridge width, and the peak-to-peak ridge distance are defined from the perspective of looking at a cross-section of the foil piece which is laying flat on and in close contact with a supporting surface. Ridge height is defined as being the maximum upward deflection of the imprinted ridges from the supporting surface. Ridge width is defined as the distance from the point at which a ridge begins to rise from the supporting surface to the point at which it returns to contact the supporting surface. Peak-to-peak ridge distance is defined as the distance between the peaks of two adjacent ridges. In the preferred embodiment, the ridge height is between 0.8 mm and 2 mm, the ridge width is between 1 mm and 2.5 mm, and the peak-to-peak ridge distance is between 2 mm and 4 mm.

As those of skill in the art will recognize, the ridge shapes need not be rounded, but may of any imprintable shape sufficient to create a series of essentially parallel channels in the foil piece. Similarly, the "floors" of the spaces between the ridges need not be rounded, but may be flat, saw-toothed, or of any other desired form.

In the preferred embodiment, the foil piece comprises an upper section approximately 2 cm long which need not be imprinted with the ridge pattern. This upper section is intended to be folded backward along an essentially horizontal line, to serve as a catch flap which will allow the insertion of a comb handle or similar tool under the catch Rap and which will thus allow the user to position the foil piece, utilizing the greater rigidity of the comb handle or other tool.

In operation, the user will comb out the hair to be treated, holding it outward to separate it from the remainder of the surrounding hair, and position the foil piece of the present invention under the hair to be treated, in as close a proximity to that hair as possible. The user will then lay the hair to be treated down over the foil piece, and apply the desired hair treatment to the hair, using the foil piece as a shield to prevent the treatment from affecting the surrounding hair. The ridge pattern serves to help control the flow of the hair treatment, and also provides catch pockets to retain the hair treatment in close proximity to the hair strands.

Once the hair treatment is applied, the foil piece may be rolled up or folded around the treated hair, retaining the treatment factor in close proximity to the hair strands and providing channels into which the hair strands and treatment factor can settle, thereby providing better contact between the treatment factor and the hair strands. The foil piece can be retained in the rolled or folded position with a pin or clip, allowing the foil piece to be retained in this position for any desired amount of time before removal.

DESCRIPTION OF THE PREFERRED EMBODIMENT

Figure 1A:
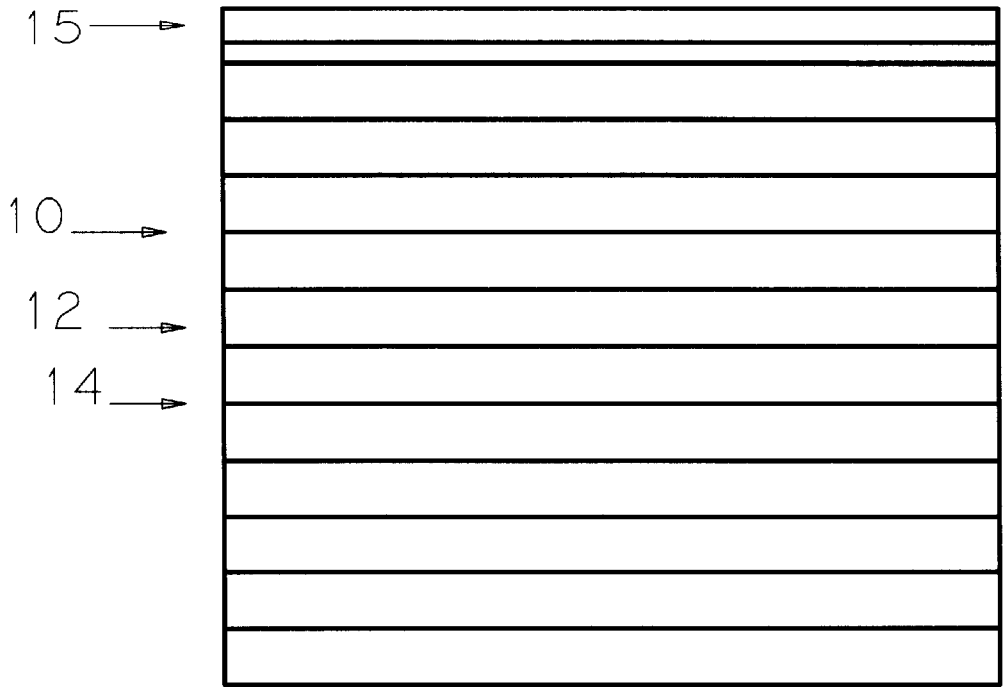
FIG. 1A is a top view of one embodiment of the foil piece of the present invention.
Figure 1B:
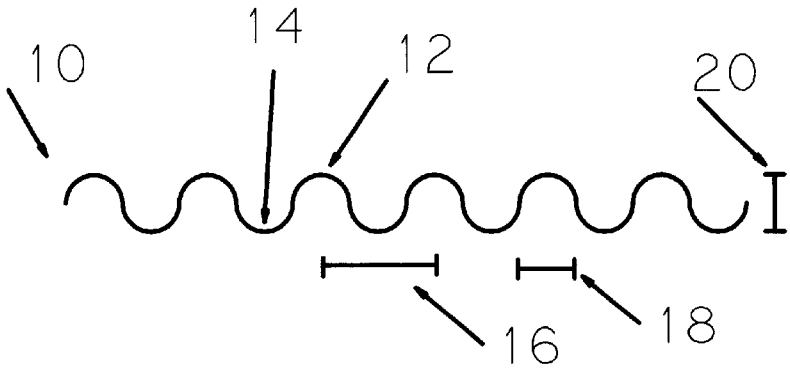
FIG. 1B is a side view of one embodiment of the foil piece of the present invention.

Referring to FIGS. 1A and 1B, the foil piece 10 of the present invention is shown. The pattern in the foil piece comprises ridges 12 and valleys 14 which are pressed into the foil piece 10 by any known mechanical means. In the preferred embodiment, the foil piece 10 comprises an upper section 15 which does not need to be imprinted with the ridge pattern, and is intended to be folded backward along an essentially horizontal line to allow the foil piece 10 to be manipulated by means of a comb handle or similar tool placed underneath the fold line.

In the preferred embodiment, the ridges 12 and valleys 14 form an essentially straight, parallel, horizontal pattern. The ridge height 20 is preferably between 0.8 mm and 2 mm. The ridge width 18 is preferably between 1 mm and 2.5 mm. The peak-to-peak ridge distance 16 is preferably between 2 mm and 4 mm. However, these measures are intended to identify the preferred regions only, and are not considered to be limits on the operational variability of these measurements.

I claim:

1. A method of coloring or tinting hair, comprising placing a foil piece comprising a ridge pattern under the hair to be colored or tinted, applying a coloring or tinting agent to the hair, and rolling or folding said foil piece around the hair after application of the coloring or tinting agent.

2. The method of claim 1, additionally comprising the step of retaining the foil piece around the treated hair for a pre-determined period of time.

3. A method of coloring or tinting hair, comprising placing a foil piece comprising a ridge pattern under the hair to be colored or tinted, aligning said ridge pattern essentially parallel to the strands of the hair to be colored or tinted, and applying a hair coloring or tinting agent to the hair to be colored or tinted.

* * * * *